US005808192A

United States Patent [19]

Schmidt

[11] Patent Number: 5,808,192

[45] Date of Patent: Sep. 15, 1998

[54] ARRANGEMENT FOR ACQUIRING DOWNHOLE INFORMATION

[75] Inventor: Harald S. Schmidt, Stavanger, Norway

[73] Assignee: Hayco Manufacturing Limited, Wanchai, Hong Kong

[21] Appl. No.: 748,753

[22] Filed: Nov. 14, 1996

[30] Foreign Application Priority Data

Nov. 17, 1995 [NO] Norway ..... 954659

[51] Int. Cl.[6] ..... E21B 47/01

[52] U.S. Cl. ..... 73/152.55; 73/250.07; 73/250.11; 73/241.1

[58] Field of Search ..... 73/152.18, 152.51, 73/152.54, 152.55; 166/250.01, 250.07, 250.11, 117, 241.1, 241.6, 242.5

[56] References Cited

U.S. PATENT DOCUMENTS

| | | | |
|---|---|---|---|
| 4,505,155 | 3/1985 | Jackson | 73/152.51 |
| 4,583,592 | 4/1986 | Gazda et al. | 166/250.07 |
| 4,678,035 | 7/1987 | Goldschild | 166/250.07 |
| 4,757,709 | 7/1988 | Czernichow | 73/152.51 X |
| 4,823,125 | 4/1989 | Rorden et al. | 166/250.11 |
| 5,117,685 | 6/1992 | Goldschild | 73/152.55 |

FOREIGN PATENT DOCUMENTS 0 586 223 A2 3/1994 European Pat. Off. .

*Primary Examiner*—Michael Brock

*Attorney, Agent, or Firm*—Jenkens & Gilchrist, a Professional Corporation

[57] ABSTRACT

An arrangement for continuously acquiring downhole information from an oil or gas producing well comprises a pipe hanger (18) suspended in the production tubing (2) above its thermal expansion joint (7) and near the production packer (6). A pipe (23) is suspended in the hanger (18) and extends into the producing zones (8,9) of the well. The pipe (23) is carrying instruments (24) for continuously monitoring local well conditions, the instrument signals being conveyed to the top of the well through instrument cables (14) running along the pipe (23), through the hanger (18) and further up along the production tubing (2). The pipe (23) also carries slide valves (25) operable through control lines (27) and packers (28) following the path of the instrument cables (14). These slide valves and packers permit separate testing of the individual production zones (8,9) of the well.

20 Claims, 2 Drawing Sheets

ARRANGEMENT FOR ACQUIRING DOWNHOLE INFORMATION

The present invention relates to an arrangement for continuously acquiring downhole information from an oil or gas producing well, comprising instruments suspended in the production tubing near the bottom thereof and above an expansion joint located near the production packer of the well, at least one instrument cable running from the instruments up along the production tubing.

Gathering downhole data has been become increasingly more common in new wells. The main reason for this is to get access to more information and thereby improve the reservoir management for the well or field. Acquisition of additional downhole information is one method of increasing the production and ultimate recovery and is therefore regarded as an important factor in any yield increasing program.

Until about ten years ago almost all downhole information was collected by intervention with wireline operated tools. These gave important data, but only for a limited period of time. The cost associated with these operations were also high. Later, when wells became deviated and also horizontal, such intervention had to be performed by use of coiled tubing, e.g. as described in EP-A2-0 586 223, which is hereby included by reference. The cost of such operations were very high and sometimes difficult to justify.

In later years, permanently installed instruments have taken over an increasing part of the data collection, in particular regarding pressure and temperature. These new systems have revealed high reliability and much more information, and in many fields they are planned for in most of the production wells. Some oil companies now install permanent downhole instruments for pressure and temperature as part of the standard completion.

The permanent systems mentioned above are placed at the bottom of the production tubing, above the production packer. This results in the instruments being situated a substantial distance from the producing reservoir level. This distance may typically be from 100 m up to 600 m. Although the data obtained this way has been of great value to the reservoir engineer in planning the field development, the location of the instruments a considerable distance above the producing reservoir will limit and restrict further expansion of reservoir control and prohibit the collection of information from individual reservoirs in one well or from various locations in a horizontal well.

The object of the present invention is therefore to avoid or at least substantially alleviate the shortcomings of the prior art systems as regards downhole information acquisition and/or production monitoring and control.

According to the invention, this is obtained by an arrangement as recited in the introductory paragraph above, the arrangement being characterized in that the instruments are arranged in an elongate member suspended in a hanger arranged in the production tubing above the expansion joint and extending into the producing part of the well below the packer, said hanger having at least one production flow channel therethrough and at least one passage for said at least one instrument cable.

Further advantageous features of the invention are recited in the dependent claims.

With an arrangement according to the invention the instruments can be placed and will be recording at the producing intervals. The production tubing may be extended down to the producing intervals while serving as an instrument carrier, providing for annular or tubing flow in the liner section. Cables and control lines can be routed to the lower part of the well without any operational conflicts with other completion components and will not be influenced by thermal expansion of the tubing. Monitoring can take place at perforation intervals and may include pressure, temperature, flow and sand detection, acoustic measurements, etc. Furthermore, continuous monitoring of temperature along the entire well from the bottom perforation to the top of the well can be obtained by the use of optical fibres deployed after completion. Control and testing of individual reservoir intervals or various sections in a horizontal well can be obtained by opening or closing for production or injection. Nevertheless, logging of the well can still be performed with standard logging tools.

For better understanding of the invention it will be described in the following with reference to the exemplifying embodiments shown in the appended drawings, wherein FIG. 1 shows, partly in longitudinal section, a part of a well provided with an arrangement according to a first embodiment of the invention;

Figure 1:
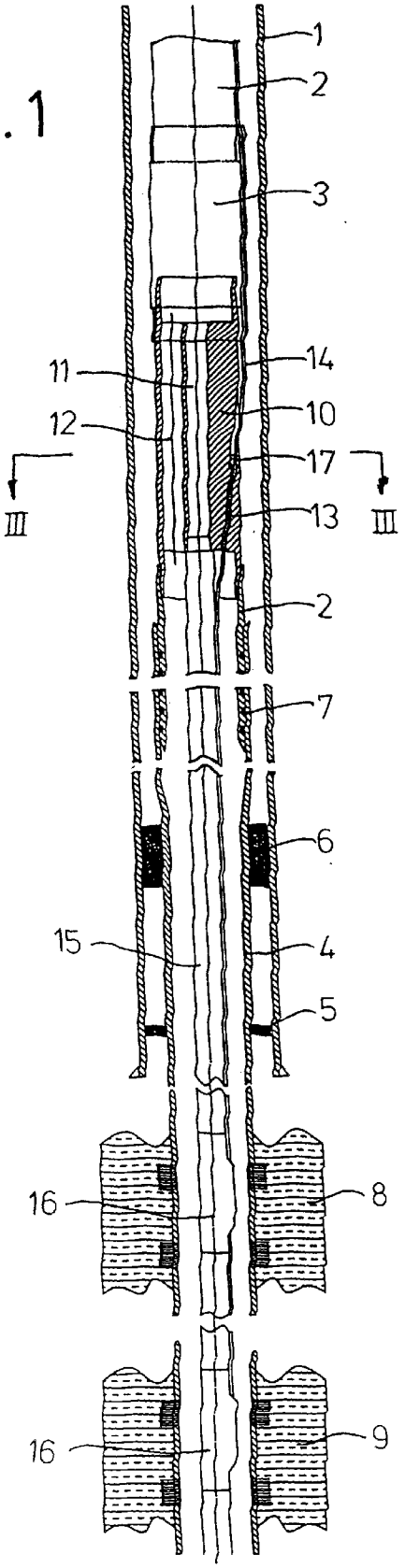
Figure 2:
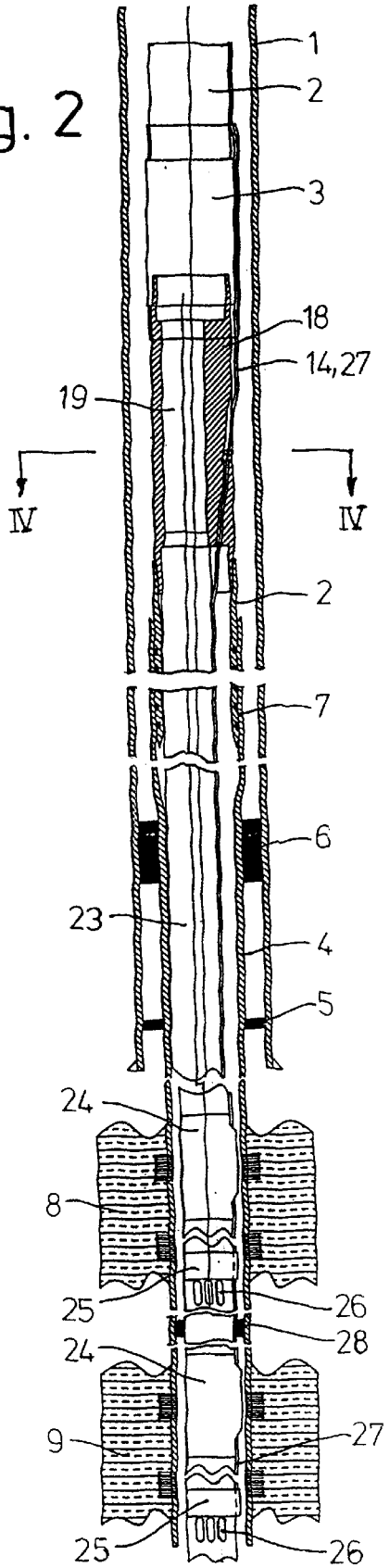
FIG. 2 shows, partly in longitudinal section, a part of a well provided with a second embodiment of the present invention.

The wells shown in FIGS. 1 and 2 both have a casing 1, production tubing 2 extending upwards to the top of the well from a pup joint 3, a liner 4 suspended in a liner hanger 5 near the lower end of the casing 1, and a production packer 6 sealing the annulus between the casing 1 and the liner 4. At the upper end of the liner 4, an expansion joint 7 is provided. The section of the liner 4 remote from the expansion joint 7 extends into the producing part of the well, two production zones 8 and 9 being shown.

Figure 3:
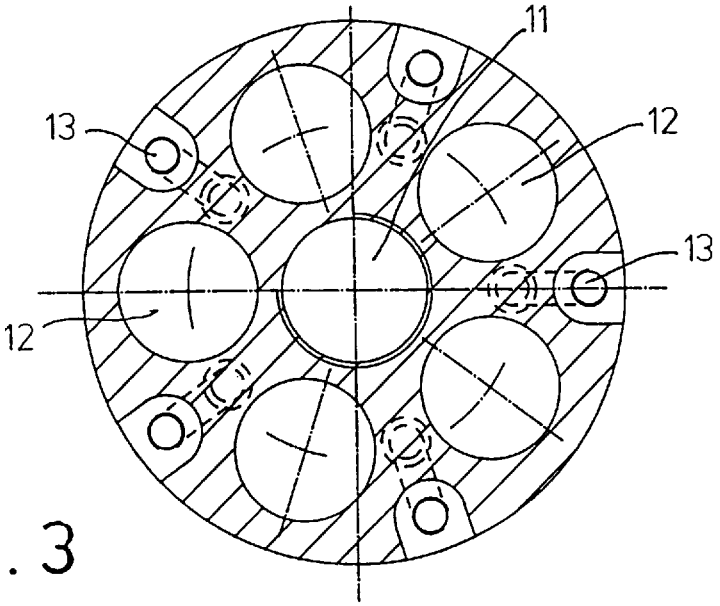
FIG. 3 shows a cross section along the line III—III in FIG. 1.

Referring now to FIG. 1, between the upper, sliding part of the expansion joint 7 and the pup joint 3 a hanger 10 according to the invention is installed. This hanger, the cross section of which is shown in FIG. 3, has a central bore 11 and a plurality of production flow channels 12 spaced in the hanger body about the central bore 11. Between the flow channels 12 the hanger body is provided with passages 13 for instrument cables 14 and/or control lines.

In the central bore 11 of the hanger 10 an elongate member 15, e.g. in the form of a 2⅜" pipe, is suspended. The pipe 15 extends into the production reservoir of the well and contains instrument carriers 16 located in the production zones 8 and 9. The instrumentation cable 14, which runs from the top of the well along the outside of the production tubing 2, traverses the hanger 10 from the outside thereof through the passage 13 to the annular space delimited by the liner 4 and the elongate member or pipe 15. The cable 14 then runs along the pipe 15 to the instrument carriers 16.

When the production tubing 2 expands or contracts due to temperature changes, the relative movement in the expansion joint 7 may be several meters. However, this movement will cause no strain in the instrument cable 14 since there will be no relative movement between the lower end of the production tubing 2, the hanger 10 and the elongate member 15 to which the instrument cable 14 is attached.

To avoid leakage from the liner 4 to the annulus above the production packer 6, the passage 13 for the instrument cable 14 through the hanger 10 is closed by suitable means, e.g. a compression fitting 17.

It will be understood that if the elongate member 15 is a pipe, its flow channel and the connected central bore 11 of the hanger 10 may serve as a production flow channel so as to minimize the flow restriction caused by the hanger 10.

The instrument carriers 16 will permit monitoring of pressure and temperature for the individual production zones, allow acoustic measurements and the recording of other parameters. Hydraulic lines may be run along with the instrument cables for control functions or injection purposes.

Figure 4:
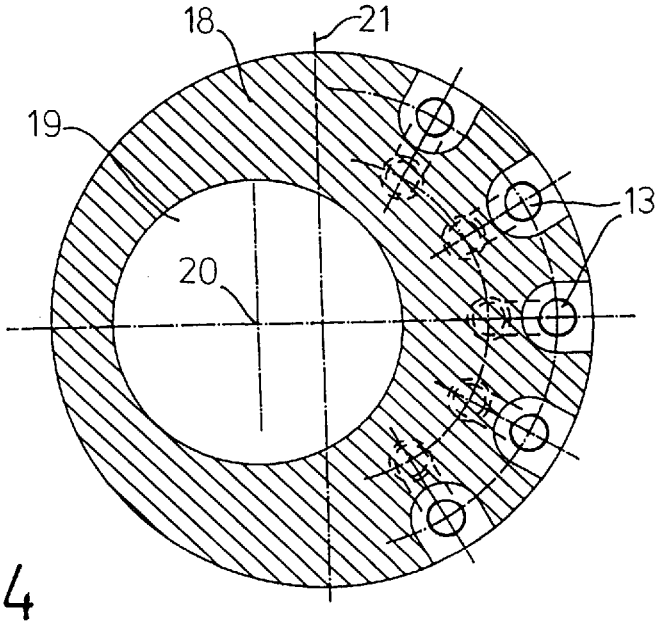
FIG. 4 shows a cross section along the line VI—VI in FIG. 2.

Turning now to FIGS. 2 and 4, a second embodiment of the invention is shown. Here, the hanger 18 has a single production flow channel 19, the central axis 20 of which being located to one side of a central plane 21 through the packer 18, while the instrument cable and control line passages 13 are located on the opposite side of said central plane.

Concentrically with the flow channel 19 an elongate member 23 in the form of an e.g. 4½" pipe is suspended in the hanger 18 and is extending down into the production part of the well inside the liner 4. In the production zones 8, 9 the pipe 23 carries instrument carriers 24 and slide valves 25 able to cover or uncover ports 26 in the pipe 23. The slide valves 25 are hydraulically operated through control lines 27 running along with the instrument cables 14.

Between the individual production zones 8,9 a packer element 28 is arranged to enable sealing the annulus between the liner 4 and the pipe 23. Thus, by setting the packer 28 and closing the slide valve 25 in the production zone 8 while leaving the valve 25 open in the zone 9, the production from the zone 9 may be tested and measured, e.g. by means of a flow measuring device arranged in the nearest instrument carrier 24 located above the open valve.

The various elements used in conjunction with the present invention, like e.g. the expansion joint 7, the instrument carriers 16, 24 and their instruments, the slide valves 25, the packers 6 and 28 and the instrument cables and control lines 24, 27, will all be known to the skilled person and need not be described in further detail in this specification.

While the invention has been described with particular reference to two embodiments, it will be understood that the invention is not limited thereto and it will be appreciated by those skilled in the art that variations and modifications may be made without departing from the spirit of the invention or the scope of the appended claims.

I claim:

1. An arrangement for acquiring downhole information from an oil or gas producing well, comprising instruments, production tubing, and an expansion joint located near a production packer of the well, at least one instrument cable running from the instruments up along the production tubing, wherein the instruments are arranged in an elongate member suspended in a hanger arranged in the production tubing above the expansion joint and extending into the producing part of the well below the production packer, said hanger having at least one production flow channel therethrough and at least one passage for said at least one instrument cable.

2. An arrangement according to claim 1, wherein said passage extends from the outside of the hanger to an annular space surrounding said elongate member.

3. An arrangement according to claim 2, wherein the elongate member is a pipe.

4. An arrangement according to claim 3, wherein the flow channel of said pipe is in flow communication with a production flow channel in the hanger.

5. An arrangement according to claim 4, wherein said pipe is provided with at least one slide valve for uncovering or closing openings in the wall of said pipe.

6. An arrangement according to claim 5, wherein said slide valve is hydraulically operated and is connected to a control line running through the pipe hanger.

7. An arrangement according to claim 6, wherein said pipe is provided with a plurality of slide valves, each associated with a respective production zone, said zones and slide valves being separated by at least one packer arranged on said pipe.

8. An arrangement according to claim 2, wherein said hanger is provided with a plurality of passages for instrument cables and control lines.

9. An arrangement according to claim 8, wherein said hanger is provided with a plurality of production flow channels.

10. An arrangement according to claim 8, wherein said hanger is provided with a single production flow channel having its central axis located to one side of a central plane through the hanger, the instrument cable and control line passages being located on the opposite side of said central plane.

11. An arrangement according to claim 1, wherein the elongate member is a pipe.

12. An arrangement according to claim 11, wherein the flow channel of said pipe is in flow communication with a production flow channel in the hanger.

13. An arrangement according to claim 12, wherein said pipe is provided with at least one slide valve for uncovering or closing openings in the wall of said pipe.

14. An arrangement according to claim 13, wherein said slide valve is hydraulically operated and is connected to a control line running through the pipe hanger.

15. An arrangement according to claim 13, wherein said pipe is provided with a plurality of slide valves, each associated with a respective production zone, said zones and slide valves being separated by at least one packer arranged on said pipe.

16. An arrangement according to claim 14, wherein said pipe is provided with a plurality of slide valves, each associated with a respective production zone, said zones and slide valves being separated by at least one packer arranged on said pipe.

17. An arrangement according to claim 16, wherein said hanger is provided with a plurality of passages for instrument cables and control lines.

18. An arrangement according to claim 1, wherein said hanger is provided with a plurality of passages for instrument cables and control lines.

19. An arrangement according to claim 18, wherein said hanger is provided with a plurality of production flow channels.

20. An arrangement according to claim 18, wherein said hanger is provided with a single production flow channel having its central axis located to one side of a central plane through the hanger, the instrument cable and control line passages being located on the opposite side of said central plane.

* * * * *